US007662274B2

(12) United States Patent
Sherman et al.

(10) Patent No.: US 7,662,274 B2
(45) **Date of Patent: *Feb. 16, 2010**

(54) METHODS OF REMOVING CONTAMINANTS FROM USED OIL

(75) Inventors: Jeffrey H. Sherman, Dallas, TX (US); Richard T. Taylor, Oxford, OH (US)

(73) Assignee: Miami University, Oxford, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/852,434

(22) Filed: Sep. 10, 2007

(65) Prior Publication Data

US 2008/0000808 A1 Jan. 3, 2008

Related U.S. Application Data

(63) Continuation of application No. 09/753,495, filed on Jan. 2, 2001, now Pat. No. 7,267,760, which is a continuation of application No. 09/418,448, filed on Oct. 15, 1999, now Pat. No. 6,179,999, which is a continuation-in-part of application No. 09/250,741, filed on Feb. 16, 1999, now Pat. No. 6,007,701.

(51) Int. Cl.
*C10M 175/02* (2006.01)

(52) U.S. Cl. ..... 208/179; 208/180; 208/181; 208/108

(58) Field of Classification Search ..... 208/179–181
See application file for complete search history.

(56) References Cited

U.S. PATENT DOCUMENTS 4,101,414 A * 7/1978 Kim et al. ..... 208/18
4,351,718 A * 9/1982 Brunelle ..... 588/318
4,381,992 A * 5/1983 Wood et al. ..... 208/179

OTHER PUBLICATIONS

Gorman, W.A. et al., A process to separate light ends, catalyst, base oils and asphalt extender from used lubricating oil . . . , PTQ, 2005, pp. 85-88, Q4.

* cited by examiner

*Primary Examiner*—Tam M Nguyen
(74) *Attorney, Agent, or Firm*—Edmonds & Nolte, P.C.

(57) ABSTRACT

In a method of removing acidic compounds, color, and polynuclear aromatic hydrocarbons, and for removing or converting hydrocarbons containing heteroatoms from used oil distillate, phase transfer catalysts are employed to facilitate the transfer of inorganic or organic bases to the substrate of the oil distillate. An inorganic or organic base, a phase transfer catalyst selected from the group including quaternary ammonium salts, polyol ethers and crown ethers, and used oil distillate are mixed and heated. Thereafter, contaminants are removed from the used oil distillate through distillation.

6 Claims, 1 Drawing Sheet

METHODS OF REMOVING CONTAMINANTS FROM USED OIL

CROSS REFERENCE TO RELATED APPLICATION

This application is a continuation application under 37 C.F.R. §1.53(b) of Ser. No. 09/753,495 U.S. Pat. No. 7,267,760 filed Jan. 2, 2001, which is a continuation application of Ser. No. 09/418,448 U.S. Pat. No. 6,179,999 filed on Oct. 15, 1999, which is a continuation-in-part application of Ser. No. 09/250,741 U.S. Pat. No. 6,007,701 filed on Feb. 16, 1999. This application is also related to U.S. Pat. No. 6,929,737 filed Jan. 2, 2001, and U.S. Pat. No. 6,398,948 filed on Sep. 18, 2000. All foregoing patents and patent applications are incorporated herein by reference.

BACKGROUND OF THE INVENTION

1. Field of the Invention

This invention relates generally to the removal of contaminants from used oil, and more particularly to a method of removing acidic compounds, color, and polynuclear aromatic hydrocarbons, and removing or converting heteroatoms from used oil distillates.

2. Description of the Related Art

It has long been recognized that used motor oils can be recycled by removing the contaminants which accumulate therein during operation of the motor vehicles in which the motor oils are utilized. Recently, the American Society for Testing and Materials (ASTM) has promulgated its Designation: D 6074-99 wherein the ASTM Committee D-2 on Petroleum Products and Lubricants has promulgated standards for re-refined base oils. Included in Designation: D 6074-99 are numerous attributes of base oils, including attributes relating to physical properties, compositional properties, chemical properties, and toxicological properties.

Prior to World War II used motor oil was re-refined using a process involving the addition of sulphuric acid in order to separate the contaminants from the useful hydrocarbon components of used motor oil. Re-refining processes of the type involving the addition of sulphuric acid to used motor oil are no longer used because they result in the generation of large amounts of highly toxic acidic sludge which cannot be disposed of economically. Additionally, such re-refining techniques do not fulfill the requirements of ASTM Designation: D 6074-99.

More recently, used motor oils have been re-refined utilizing a process known as hydrotreating. In accordance with the hydrotreating process, used motor oils are treated with hydrogen under high pressure. Hydrotreating is successful in removing olefins and alkanes from used motor oils and can also be used in removing heteroatoms therefrom. However, the hydrotreating process is expensive to the point that it cannot be operated profitably.

U.S. Pat. No. 5,814,207 discloses a used motor oil re-refining method and apparatus wherein up to four evaporators are connected one to another in a series. It will therefore be understood that the apparatus of the '207 patent is expensive to install and use. More importantly, the used motor oil re-refining method of the '207 patent cannot meet the requirements of ASTM Designation: D 6074-99 because it cannot remove heteroatoms and because it cannot meet the toxicological requirements of the designation.

Co-pending U.S. application Ser. No. 09/250,741 filed Feb. 16, 1999, and assigned to the assignee hereof discloses a re-refining process wherein used motor oil is treated with an organic or inorganic base in the presence of a phase transfer catalyst. The process is successful in removing acidic compounds, color, and polynuclear aromatic hydrocarbons and in removing or substituting heteroatoms from used motor oil distillates. Co-pending U.S. application Ser. No. 09/265,903 filed Mar. 24, 1999, and also assigned to the assignee hereof discloses a re-refining process wherein used motor oil is contacted with a highly polar organic solvent, such as N,N-dimethylformamide. The process is successful in removing polynuclear aromatic hydrocarbons, sulphur-containing substances, nitrogen-containing substances, and other contaminants from used motor oil and distillates. The present invention comprises a process for re-refining used motor oils which is an improvement over the process of application Ser. No. 09/250,741. The process of the invention is unique in that it is the only known process which safely and economically fulfills all of the requirements of ASTM Designation: D 6074-99.

BRIEF DESCRIPTION OF THE DRAWINGS

A more complete understanding of the invention may be had by reference to the following Detailed Description when taken in conjunction with the accompanying Drawings wherein.

DETAILED DESCRIPTION OF THE PREFERRED EMBODIMENT

Figure 1:
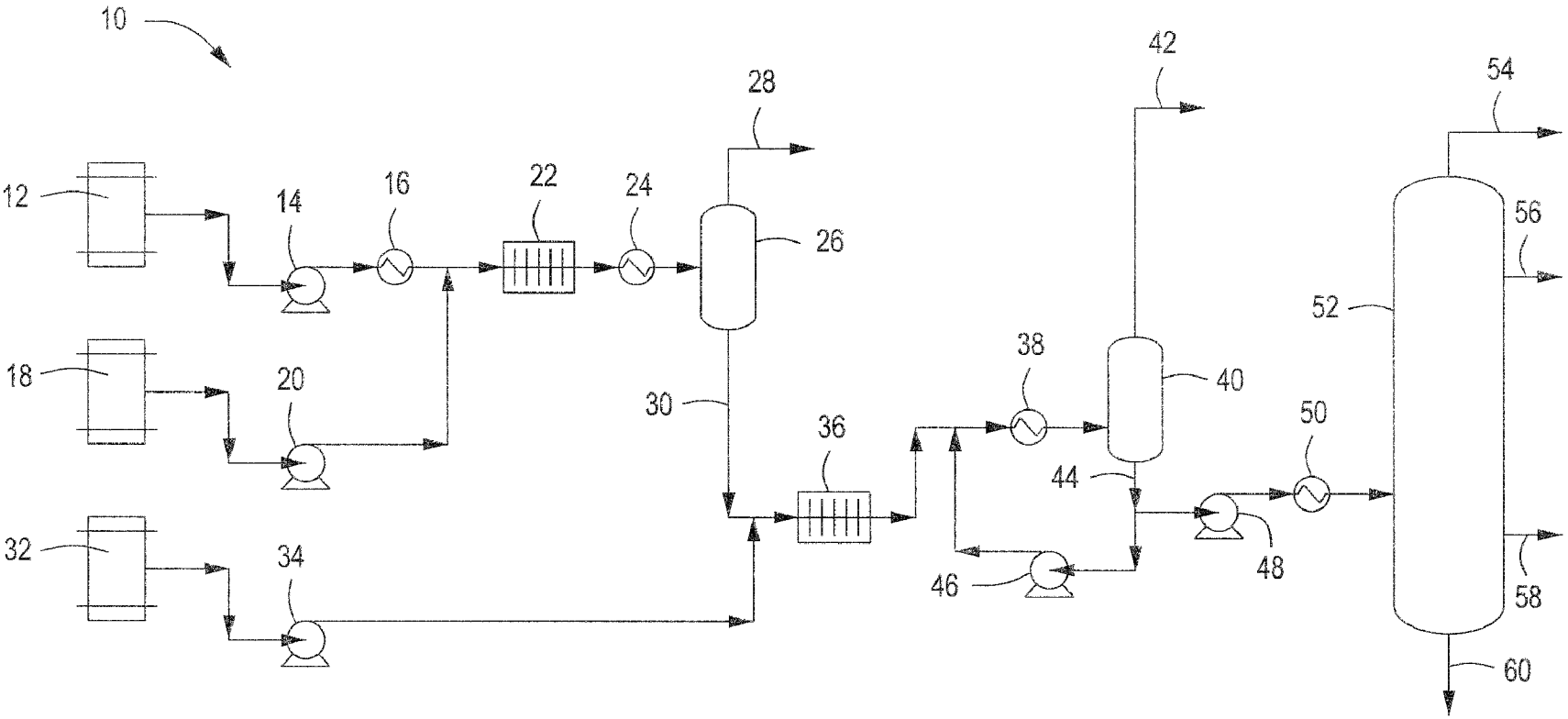
FIG. 1 is a diagrammatic illustration of a continuous flow apparatus catalyzed base treatment of used motor oil to remove contaminants therefrom.

The process of the present invention removes acidic compounds and color from used motor oil and other petroleum distillates. Additionally, the process removes or substitutes hydrocarbons containing heteroatoms, namely chlorine, boron, phosphorous, sulfur and nitrogen from the used motor oil. In removing these classes of compounds, the process uses inorganic or organic bases to catalyze various reactions and to neutralize organic acids. Further, the process is capable of removing polynuclear aromatic hydrocarbons from used motor oil. In removing these contaminants, the process makes use of a class of catalysts known as phase transfer catalysts, which are employed in the process to facilitate the transfer of inorganic or organic bases to the substrate in the used oil.

Examples of phase transfer catalysts that may be utilized in the process of the present invention include: quaternary ammonium salts, polyol ethers, glycols, crown ethers, and other catalysts having similar properties. Through either the base catalysis and/or the neutralization reactions, undesirable components of the distillate oil may be converted to forms that are easily removed from the used oil through distillation. Components that are not removed from the distillate may be transposed to forms that may remain in the distillate with no adverse effect on the oil quality.

The invention is capable of operating in either a batch mode or a continuous flow mode. When the process is operated in the continuous flow mode, the catalyst and the base may be injected into the used oil and passed through a heat exchanger to increase the temperature of the mixture. The mixture may then be pumped through one or more static mixers to thoroughly mix the used oil with the catalyst and base. The mixture is then passed directly to the distillation apparatus, where additional mixing occurs and the catalyst and resulting oil are recovered separately. The catalyst is recovered in a form virtually free of hydrocarbon contamination. However, the catalyst may contain small quantities of water, typically less than 1%, which is usable directly in the process.

Although other phase transfer catalysts can be used in the process, the use of ethylene 5 glycol generally provides a benefit over other phase transfer catalysts, as the source of the catalyst can be a glycol-based engine coolant. Thus, the catalyst can be commonly acquired in raw form with little, if any, expenditure.

The relative amounts of base and phase transfer catalyst are generally predicated upon the level of contamination in the used oil. Thus, used oil containing greater than 500 parts-per-million total organic halogen would generally require a higher concentration of base and phase transfer catalyst to ensure that the dehalogenation reactions occur within a time-frame suitable for a continuous flow process.

A further benefit of the continuous flow mode is the fact that the only wastewater generated by the process is that which is originally present in the used oil and the small amount present in the base. No further water is required for the process. Additionally, all of the wastewater is recovered following distillation of the water and is therefore acceptable for direct discharge. If further treatment of the wastewater is required, the treatment scheme employed is minimal.

An exemplary process for removing contaminants from used motor oil 10 may include a continuous flow process as shown in FIG. 1. In the exemplary process 10, the used oil from a source 12 is passed through a used oil feed pump 14 to a heater 16. At the same time, a 50% aqueous solution of sodium or potassium hydroxide from a source 18 is passed through a caustic feed pump 20 and into the used oil after it passes through and is heated to 70 to 100° C. by a heater 16. The amount of sodium or potassium hydroxide added to the used oil is such that the concentration of base in the oil, on a dry weight basis, is between 0.5 and 5 weight percent. The used oil and the sodium or potassium hydroxide passes through a caustic mixer 22 and a heater 24, heating the mixture to 110 to 150° C. The used oil mixture is then passed into a water flash drum 26 where water and a small amount of naphtha are removed through flash outlet 28. The water flash drum is best operated at atmospheric pressure, thus allowing a higher feed temperature to promote the reactions. However, in principle the flash drum could operate under vacuum, or other suitable pressure. The resultant dehydrated used oil mixture is then removed from the water flash drum 26 through a flash oil outlet 30.

Ethylene glycol from a source 32 is passed through a catalyst feed pump 34 and into the dehydrated used oil mixture. The amount of ethylene glycol that is added to the used oil is such that the concentration of glycol in the resulting mixture may range from 1 to 10 weight percent of the used oil. The used oil feed pump 14, the caustic feed pump 20, and the catalyst feed pump 34 are each engaged at flow rates that provide the desired amounts of each material. The used oil mixture is passed through a catalyst mixer 36 and a heater 38, where it is heated to between about 275 and 350° C., and proceeds into a stage I evaporator 40. Heating the mixture beyond 350° C. is not recommended as temperature above 350° C. result in excessive cracking of the used oil molecules. The stage I evaporator is typically operated under vacuum, with pressures ranging from about 150 to 300 millimeters of mercury. The catalyst and light hydrocarbons are removed through flash catalyst outlet 42 and the oil is removed through oil outlet 44. Part of the oil passes through a recycle pump 46 and back into the dehydrated used oil mixture after the catalyst mixer 36, but before the heater 38.

The remainder of the oil passes through a finishing pump 48 and a heater 50, where it is heated to from about 300 to 350° C., and into a stage II evaporator 52. The stage II evaporator operates under vacuum with pressures ranging from 5 to 0.05 millimeters of mercury. The stage II evaporator may be operated at lower temperatures and pressures, but this will result in a lower yield of the heavier base oil product. The stage II evaporator separates the oil into three fractions, the viscosities of which depend upon the used oil feed. The table below lists products from a typical used oil feed:

| Fraction | Color | Chlorine | Viscosity |
|---|---|---|---|
| Light base oil | <0.5 | <5 ppm | 100 SUS |
| Medium base oil | <1.0 | <5 ppm | 150 SUS |
| Heavy base oil | <1.5 | <5 ppm | 300 SUS |
| Still bottoms | n/a | n/a | n/a |

The light base oil is recovered through outlet 54, the medium base oil through outlet 56, the heavy base oil through outlet 58, and the still bottoms through outlet 60.

The still bottoms resulting from the simultaneous combination of the catalyzed base treatment with distillation yields important properties when combined with asphalt. In general, the still bottoms comprise a high value asphalt modifier, capable of extending the useful temperature range of most straight run asphalts. Specifically, the still bottoms impart favorable low temperature characteristics to asphalt, while maintaining the high temperature properties of the asphalt.

Although preferred embodiments of the invention have been illustrated in the accompanying drawings and described in the foregoing detailed description, it will be understood that the invention is not limited to the disclosed embodiments, but is capable of numerous rearrangements, modifications, and substitutions of parts and elements without departing from the spirit of the invention.

What is claimed is:

1. A method for purifying used oil, comprising:

mixing a raw used oil with a base compound to form a mixture comprising used oil and base compound;

processing the mixture comprising used oil and base compound to provide a used oil mixture comprising used oil and base compound;

adding a phase transfer catalyst to the used oil mixture comprising used oil and base compound to provide a used oil mixture comprising used oil, phase transfer catalyst, and base compound, wherein the phase transfer catalyst comprises a glycol; and removing contaminants from at least a portion of the used oil mixture comprising used oil, phase transfer catalyst, and base compound.

2. The method of claim 1, wherein the phase transfer catalyst comprises ethylene glycol.

3. The method of claim 1, wherein removing contaminants from at least a portion of the used oil mixture comprising used oil, phase transfer catalyst, and base compound comprises distilling the used oil mixture at a temperature of about 200° C. to about 275° C. and a pressure of about 100 Torr to about 200 Torr.

4. A method for purifying used oil, comprising:

mixing a raw used oil with a base compound to form a mixture comprising used oil and base compound;

processing the mixture comprising used oil and base compound to provide a used oil mixture comprising used oil and base compound;

adding a phase transfer catalyst to the used oil mixture comprising used oil and base compound to provide a used oil mixture comprising used oil, phase transfer catalyst, and base compound, wherein the phase transfer catalyst comprises a glycol; and removing contaminants from at least a portion of the used oil mixture comprising used oil, phase transfer catalyst, and base compound, wherein the base compound is an inorganic base compound selected from the group consisting of sodium hydroxide, potassium hydroxide, and combinations thereof, and wherein the used oil mixture comprising used oil, phase transfer catalyst and base compound comprises of from about 1% to about 10% by weight of the phase transfer catalyst.

5. The method of claim 4, wherein the used oil comprises motor oil.

6. The method of claim 4, wherein removing contaminants from at least a portion of the used oil mixture comprising used oil, phase transfer catalyst, and base compound comprises distilling the used oil mixture at a temperature of about 200° C. to about 300° C. and a pressure of about 0.05 Torr to about 200 Torr.

* * * * *